US011084053B2

(12) United States Patent
Jia

(10) Patent No.: US 11,084,053 B2
(45) Date of Patent: Aug. 10, 2021

(54) PORTABLE PUMP BY WHICH LIQUID MAY BE HORIZONTALLY PRESSED OUT

(71) Applicant: Gemmytec (shanghai) Co., LTD., Shanghai (CN)

(72) Inventor: Chaoyang Jia, Shanghai (CN)

(73) Assignee: GEMMYTEC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/763,929

(22) PCT Filed: Dec. 5, 2017

(86) PCT No.: PCT/CN2017/114615
§ 371 (c)(1),
(2) Date: May 13, 2020

(87) PCT Pub. No.: WO2019/095456
PCT Pub. Date: May 23, 2019

(65) Prior Publication Data

US 2020/0384489 A1 Dec. 10, 2020

(30) Foreign Application Priority Data

Nov. 14, 2017 (CN) ..... 201711120506.6

(51) Int. Cl.
*B05B 11/00* (2006.01)

(52) U.S. Cl.
CPC ..... *B05B 11/3001* (2013.01); *B05B 11/309* (2013.01); *B05B 11/007* (2013.01); *B05B 11/0037* (2013.01); *B05B 11/3074* (2013.01)

(58) Field of Classification Search
CPC ..... B05B 11/3001; B05B 11/309; B05B 11/0037; B05B 11/007; B05B 11/3074
See application file for complete search history.

(56) References Cited

U.S. PATENT DOCUMENTS 10,549,297 B2 * 2/2020 Ballot ..... B05B 11/3002
2002/0134798 A1 * 9/2002 Lamboux ..... B05B 11/3011 222/251
2004/0222243 A1 * 11/2004 Sweeton ..... B05B 11/3076 222/383.1

(Continued)

FOREIGN PATENT DOCUMENTS

CN 206125797 U * 4/2017

*Primary Examiner* — Donnell A Long
(74) *Attorney, Agent, or Firm* — Brandon V. Zuniga; James R. Gourley; Carstens & Cahoon, LLP

(57) ABSTRACT

A portable pump by which liquid may be horizontally pressed out, comprising a liquid storage container, a pump head being provided at a side of the liquid storage container, and a liquid suction device that is connected to the pump head being provided within the liquid storage container. The liquid suction device comprises a liquid suction chamber, a spring, a piston, and a liquid outlet pipe that is connected to the pump head. The liquid suction chamber is provided with a liquid inlet pipe and a fixed end of the spring, check valves being provided within the liquid outlet pipe and the liquid inlet pipe. The piston is sleeved with the liquid outlet pipe and provided with a through hole that matches an opening of the liquid outlet pipe. The pump can comprise a locking seat on the side of the liquid storage container that matches a pump head cover.

9 Claims, 6 Drawing Sheets

(56) References Cited

U.S. PATENT DOCUMENTS

| | | | | |
|---|---|---|---|---|
| 2005/0189379 | A1* | 9/2005 | Py | G01F 11/021 222/321.7 |
| 2013/0292414 | A1* | 11/2013 | Sutherland | A47K 5/1201 222/107 |
| 2015/0090739 | A1* | 4/2015 | Jung | B05B 11/0072 222/205 |
| 2015/0158042 | A1* | 6/2015 | Parker | A44C 5/003 222/175 |
| 2016/0262523 | A1* | 9/2016 | Kim | B05B 11/3032 |

* cited by examiner

PORTABLE PUMP BY WHICH LIQUID MAY BE HORIZONTALLY PRESSED OUT

RELATED APPLICATION

This application is a U.S. National Stage of International Application No. PCT/CN2017/114615, filed on Dec. 5, 2017, and published as WO 2019/095456 on May 23, 2019, which claims priority to the Chinese Application No. CN 201711120506.6, titled "Portable Pump By Which Liquid May Be Horizontally Pressed Out," filed with the Chinese Patent Office on Nov. 14, 2017. Each application, publication, and patent listed in this paragraph are hereby incorporated by reference in their entireties.

TECHNICAL FIELD

The present disclosure relates to the field of lotion pumps, and particularly relates to a portable pump by which liquid may be horizontally pressed out.

BACKGROUND

At present, the lotion pumps available on the market, which are similar to the liquid suction pumps used in bottled shampoo, can output the lotion in the bottle by pressing the pump head. However, with the improvement of living standards, people have higher and higher requirements on personal hygiene and safety, and carrying bottled hand-washing-free lotions with them has successively become a general situation. For portable considerations, hand-washing lotions are generally placed in portable pumps. Portable pump of prior art, such as the Chinese patent CN2016210243998 discloses a horizontal squeeze-type mechanical pump. The pump comprises a liquid storage container to store liquid, a hanging ring which is provided on the liquid storage container, and a pump body which is provided on the liquid storage container. The hanging ring is hung on the belt or the pocket of the clothes such that it can be carried around. In order to allow the user to operate with one hand, the pump head is provided on the side of the liquid storage container, allowing the user to press the pump head with one hand to suction liquid from the liquid storage container and let the hand wash lotion be squeezed out from the pump head on the side of the liquid storage container to conduct hand washing and cleansing operations.

For the portable pump mentioned above, since the pump head is provided on the side of the liquid storage container, the liquid suction device embedded in the liquid storage container is arranged horizontally, and when the pump head is pressed horizontally, the pump head is embedded in the liquid storage container and let the internal liquid suction device output the lotion in the liquid storage container from the pump head. In this process, a gap is prone to exist between the pump head arranged horizontally and the liquid storage container, the pump head is connected to the liquid suction device, and since the liquid outlet of the pump head is located on one side of the liquid storage container, the lotion is easy to seep out of the gap, there is a risk of liquid leakage. If the lotion seeps out, it will stain the user's clothing and affect hygiene and safe use. Therefore, the portable pumps of the prior arts can no longer meet the needs of the development of the current lotion pump technology, meeting the needs is the direction of research and improvement by manufacturers at present.

SUMMARY

The purpose of the present disclosure is to provide a portable pump by which liquid may be horizontally pressed out. It provides improvements on the problem of the presence of the gap causing liquid leakage and liquid seepage caused by the liquid outflow structure with a pump head which is pressed on the side. It redesigns the liquid outflow structure for pressing, which effectively controls the quantitative output of the stored liquid, improves the liquid output effect and improves the user experience on the premise of ensuring the tightness, such that the user can conveniently carry it around and use it with ease.

In order to achieve aims mentioned above, the technical solution of the present disclosure:

A portable pump by which liquid may be horizontally pressed out comprises: a liquid storage container, a pump head that is provided on one side of the liquid storage container, and a liquid suction device which is connected to the pump head and provided in the liquid storage container. The liquid suction device comprises a liquid suction chamber, a spring, a piston and a liquid outlet pipe connected to the pump head, the liquid suction chamber is provided with a liquid inlet pipe and a fixed end of the spring, and the liquid outlet pipe and the liquid inlet pipe are provided with a check valve, respectively; the piston is sleeved with the liquid outlet pipe, and is provided with a through hole that matches the pipe orifice of the liquid outlet pipe; one end of the spring is fixed at the fixed end, and the other end is connected to the piston, and under the pressing of the pump head, the piston is driven to horizontally displaced in the liquid suction chamber; when the piston is reset, the liquid in the liquid storage container is pumped into the liquid suction chamber from the liquid inlet pipe; when the piston is pressed, the liquid in the liquid suction chamber is squeezed into the liquid outlet pipe and pumped out of the pump head.

Compared with the prior art, the portable pump by which liquid may be horizontally pressed out of the present disclosure provides improvements on the structure that a pump head is provided on the side to press the liquid out. A liquid suction device is provided in the liquid storage container. The liquid suction device comprises a liquid suction chamber, a spring, a piston and a liquid outlet pipe connected to the pump head, a liquid inlet pipe communicated to the liquid storage container is provided on a lower side of the liquid suction chamber, and a fixed end of the spring is further provided in the liquid suction chamber. The liquid outlet pipe and the liquid inlet pipe are provided with a check valve, respectively, and the check valve of the liquid inlet pipe only opens to inside of the liquid suction chamber, and the check valve of the liquid outlet pipe only opens to the direction of the pump head; the piston is sleeved with the liquid outlet pipe, and the bottom of the piston is provided with a through hole that matches the pipe orifice of the liquid outlet pipe; one end of the spring is fixed to the fixed end, and the other end thereof is connected to the piston; when the user operates the pump head and presses horizontally into the liquid storage container, the piston is driven to displace horizontally in the liquid suction chamber, squeeze the stored liquid in the liquid suction chamber into the liquid outlet pipe and pumped out of the pump head; when the piston is reset, the liquid in the tank is pumped into the liquid suction chamber from the liquid inlet pipe, prepared for the next liquid outlet, which allows the portable pump to quantitatively output the liquid. Due to the cooperation between the piston and the liquid outlet pipe in the liquid suction chamber, the piston and the inner wall of the liquid suction chamber are in close contact. During the operation of pressing the liquid, it can effectively play the role of sealing isolation, avoiding the leakage of the stored liquid, and ensuring the sealing performance, which allows the portable pump to effectively control the quantitative output of the stored liquid under the sealed state, improves the liquid output effect, and improve the user experience, such that the user can conveniently carry it around and use it with ease.

Furthermore, it further comprises a locking structure of the pump head, the pump head is shaped as a cap, the locking structure is a locking seat provided on the side of the liquid storage container and matching with the pump head cover, the locking seat is a ring opening with a ring-shaped opening, a positioning block is provided in the ring opening; a convex ring sleeved with the ring opening is provided at a bottom of the pump head, and a notch and a limiting convex edge are provided on the convex ring. When the pump head is operated to rotate, the convex ring rotates axially in the ring opening. When the notch and the positioning block are aligned and fitted, the pressing movement of the pump head is unlocked; otherwise, the positioning block and the convex ring are abutted with each other, thereby limiting the pressing operation of the pump head. Especially for such a portable pump body that is close to the user's clothes, since the portable pump is designed to press the liquid horizontally on the side, it is more important for its sealing performance, otherwise it will cause hygiene problems for the user's clothes. In order to further enhance the sealing performance of the liquid outlet structure, a locking structure is provided for the linkage mechanism of the pump head and the liquid suction device, and the pump head can be rotated on the locking seat by providing a locking seat to cooperate with the cap-shaped pump head cover to realize the switch setting. The user can operate the rotation of the pump head with one hand. When the pump head is rotated at a certain angle, it can be preferably set to a matching structure of 45 degrees. When the notch of the convex ring at the bottom of the pump head is aligned with the positioning block of the locking seat, the pump head is in an unlocked state. The positioning block is engaged with the notch and the pump head pressing movement is unlocked, the user can press the pump head to conduct the liquid outlet operation; otherwise, the positioning block will abut with the convex ring and the pump head pressing operation is limited.

Still further, a depth of the notch is adapted to a height of the positioning block, and matches with a horizontal displacement stroke of the piston in the liquid suction chamber. It is benefit to the high combination between the locking structure and the liquid suction device. When the pressing movement of the pump head is unlocked, a stroke of the pump head pressed by the user, the depth of the notch embedded in the positioning block in the locking structure, and the horizontal displacement stroke of the piston within the liquid suction chamber in the liquid suction device could effectively control the quantity of liquid output accurately and further enhance the sealing performance.

On the basis of the above, the convex ring is further provided with a positioning groove, one end of the limiting convex edge is connected to the notch, and the other end thereof is connected to the positioning groove; the positioning block rotates along with the pump head, slides against and along the surface of the convex ring until the positioning block reaches the limiting convex edge, and inserts into the positioning groove, such that the pump head is in a locked state. After the pump head is turned to a certain angle, it can be matched with the above unlocked state, and is preferably set to a matching structure of reversed 45-degree. The positioning block of the locking structure slides into the positioning groove to form a locked state, such that the pump head is locked and fixed to avoid the situation of liquid leakage and liquid seepage.

To further improve the matching structure of the locking structure and the liquid suction device, a liquid outlet nozzle is provided on a side of the pump head, and the opening of the liquid outlet faces a middle portion of the pump head; when the pump head is in the unlocked state, the liquid outlet nozzle is located on an upper side of the pump head. For a portable pump that presses the liquid out on the side, when the user conducts the rotating operation to the pump head and rotates the liquid outlet nozzle on the pump head to the upper side, the pressing movement of the pump head is unlocked, the user can press the pump head to let the stored liquid flow out of the opening of the liquid outlet nozzle downward, and use the stored liquid.

On the basis of the above, the liquid outlet pipe comprises a connecting end embedded at the bottom of the pump head, and a liquid guiding pipe sleeved by the piston. The connecting end is shaped as a round disk and is provided with a liquid outlet channel in communication with the liquid guiding pipe is provided on it. The liquid outlet channel extends outward, an edge of the connecting end aligned with an end opening of the liquid outlet channel is provided with positioning slot; the bottom of the pump head is further provided with an inner ring, the inner ring is provided with a convex block aligned with the notch. When the pump head is in the unlocked state, the positioning slot of the connecting end and the convex block on the inner ring of the pump head are embedded and positioned with each other, such that the liquid outlet nozzle on the pump head and the end opening of the liquid outlet channel are aligned with each other. The portable pump of the present disclosure improves the structure of the liquid outlet pipe in order to further make the locking structure closely match with the liquid outlet structure of the liquid suction device, it comprises a connecting end and a liquid guiding pipe; a liquid outlet channel is provided in the connecting end, one end of the liquid outlet channel communicates with the liquid guiding pipe, and the other end thereof extends outward, such that the end opening of the liquid outlet channel is located on one side of the connecting end. The edge of the connecting end is further provided with a positioning slot that is aligned with the end opening of the liquid outlet channel. In cooperation, the bottom of the pump head is further provided with an inner ring, and the inner ring is provided with a convex block in alignment with the notch. When the user operates the pump head to rotate and unlock, the positioning slot of the connecting end and the convex block on the inner ring of the pump head are embedded and positioned with each other, such that the liquid outlet nozzle on the pump head and the end opening of the liquid outlet channel are aligned with each other. In this state, the operation of pressing the liquid out of the pump head is conducted, and the stored liquid is pumped into the liquid guiding pipe from the liquid suction chamber through the through hole of the piston, then into the liquid outlet channel on the connecting end, and finally flows out of the liquid outlet nozzle. Since the liquid outlet channel is in a vertical state at the moment, after liquid output, the residual liquid will return to the liquid guiding pipe with the liquid outlet channel, which effectively forms a structure to control the return of residual liquid so as to avoid leakage of residual liquid remaining on the liquid outlet nozzle, affecting hygiene of clothes for users.

To further improve the structure of the liquid suction device, a sidewall of the liquid suction chamber is further provided with a vent hole, the vent hole is located on a lower side of the liquid suction chamber, and is isolated by the piston, such that the vent hole is isolated from a liquid storage space of the liquid suction chamber. In order to allow the air pressure in the liquid storage container to flow and allow the liquid suction device to suction out the liquid normally, it is necessary to provide a structure in the liquid suction chamber for exchanging external air. Therefore, a vent hole is provided on the sidewall of the liquid suction chamber and isolatedly set by the piston. When the user presses the pump head, the piston displaces horizontally into the liquid suction chamber to squeeze out the stored liquid in the storage space of the liquid suction chamber. At the same time, the vent hole at the other end of the piston would conduct an air exchange between the external air and the liquid storage container, such that the inside of the liquid storage container can communicate with the external air pressure through the liquid suction device, and therefore the portable pump can maintain the normal liquid pumping operation.

The structure of the liquid storage container of the portable pump is further improved. The liquid storage container comprises a front cover and a rear cover that are horizontally assembled. A sealing ring is provided at the joint between the front cover and the rear cover. The pump head is provided at a middle portion of a side of the front cover. On one hand, the liquid storage container is composed of a front cover and a back cover that are horizontally assembled. The front cover and the back cover can be processed and produced separately, or combined with different colors, which increases the appearance and is more benefit to the installation of liquid suction device and components of the pump head to improve the production efficiency; on the other hand, the pump head is set at the middle portion of the side of the front cover, which is benefit to distribute the force for pressing the pump head on the side such that the liquid storage container is evenly stressed, which ensures the stability of the portable pump and extends the service life.

Still further, a fixed end of the spring is provided at a middle portion of an inner side of the rear cover, and the fixed end is a protrusion horizontally sleeved by the spring, and a concave ring is formed between an outer side of the protrusion and an inner wall of the liquid suction chamber. When the piston is pressed to gradually assemble the protrusion, the stored liquid in the liquid suction chamber is concentrated back through the concave ring, squeezed out through the through hole of the piston and pumped into the liquid outlet pipe. For this type of portable pump that presses the pump head on the side, since the entire liquid suction device and pump head are horizontally arranged in the liquid storage container, the stored liquid is not evenly distributed on the peripheral wall of the liquid suction device, which is different from the usual pump arranged vertically. In order to enhance the pumping effect of the piston, the fixed end of the spring is improved. The fixed end is a protrusion horizontally sleeved by the spring. A concave ring is formed between the outer side of the protrusion and the inner wall of the liquid suction chamber. The concave ring, the piston and the inner wall of the liquid suction chamber are enclosed together to form a return channel for the liquid storage. When the piston is pressed and gradually assembled protrusion, the stored liquid in the liquid suction chamber is concentrated back through the concave ring, squeezed out through the through hole of the piston and pumped into the liquid outlet pipe, such that the stored liquid can be efficiently output and the residual liquid in the storage space of the liquid suction chamber can be avoided to be mixed with the stored liquid that is newly pumped into the storage space at the next time, which affects the quality of the outputting stored liquid.

On the basis of the above, a top of the rear cover is further provided with a hanging ring, the upper portion of the rear cover is provided with a liquid filling hole, and a hole plug is provided on the liquid filling hole. On one hand, the hanging ring is benefit for the user to hang the portable pump on the belt or the pocket of the clothing and carry it with him. On the other hand, the user can add the stored liquid through a liquid filling hole provided on the upper part of the rear cover, and seal the liquid filling hole through a hole plug for use.

DETAILED DESCRIPTION OF THE EMBODIMENTS

A portable pump by which liquid may be horizontally pressed out according to the present disclosure will be described with reference to the drawings.

Figure 1:
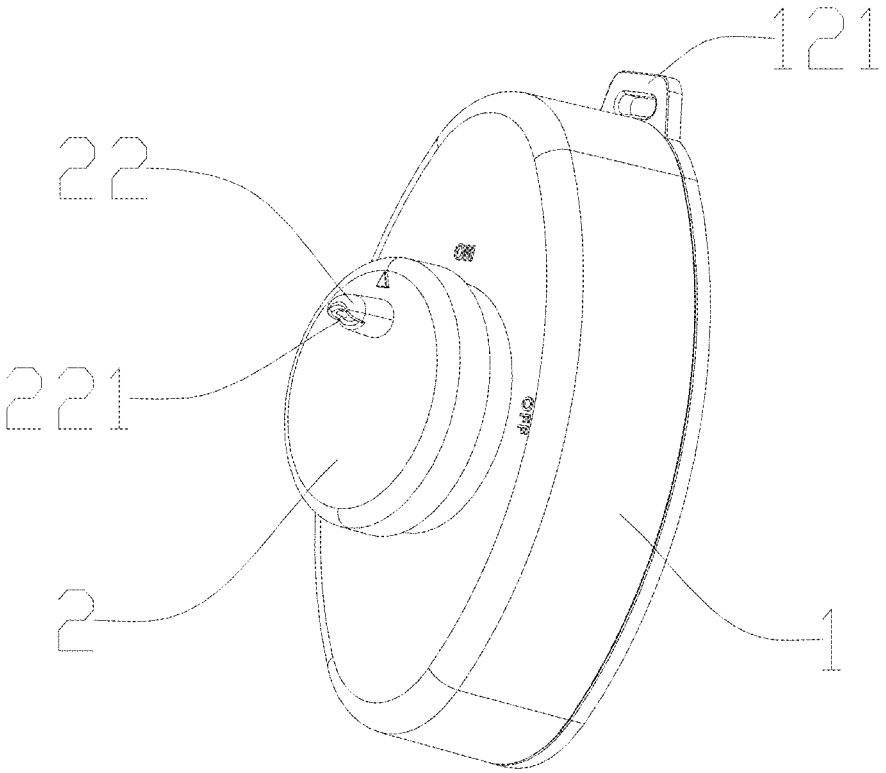
FIG. 1 is a structural view of a portable pump which can press liquid out horizontally according to the present disclosure.

As shown in FIG. 1, the portable pump comprises a liquid storage container 1. The liquid storage container 1 is provided with a pump head 2 on a side thereof, and a liquid suction device connected to the pump head 2 is provided in the liquid storage container 1.

Figure 2:
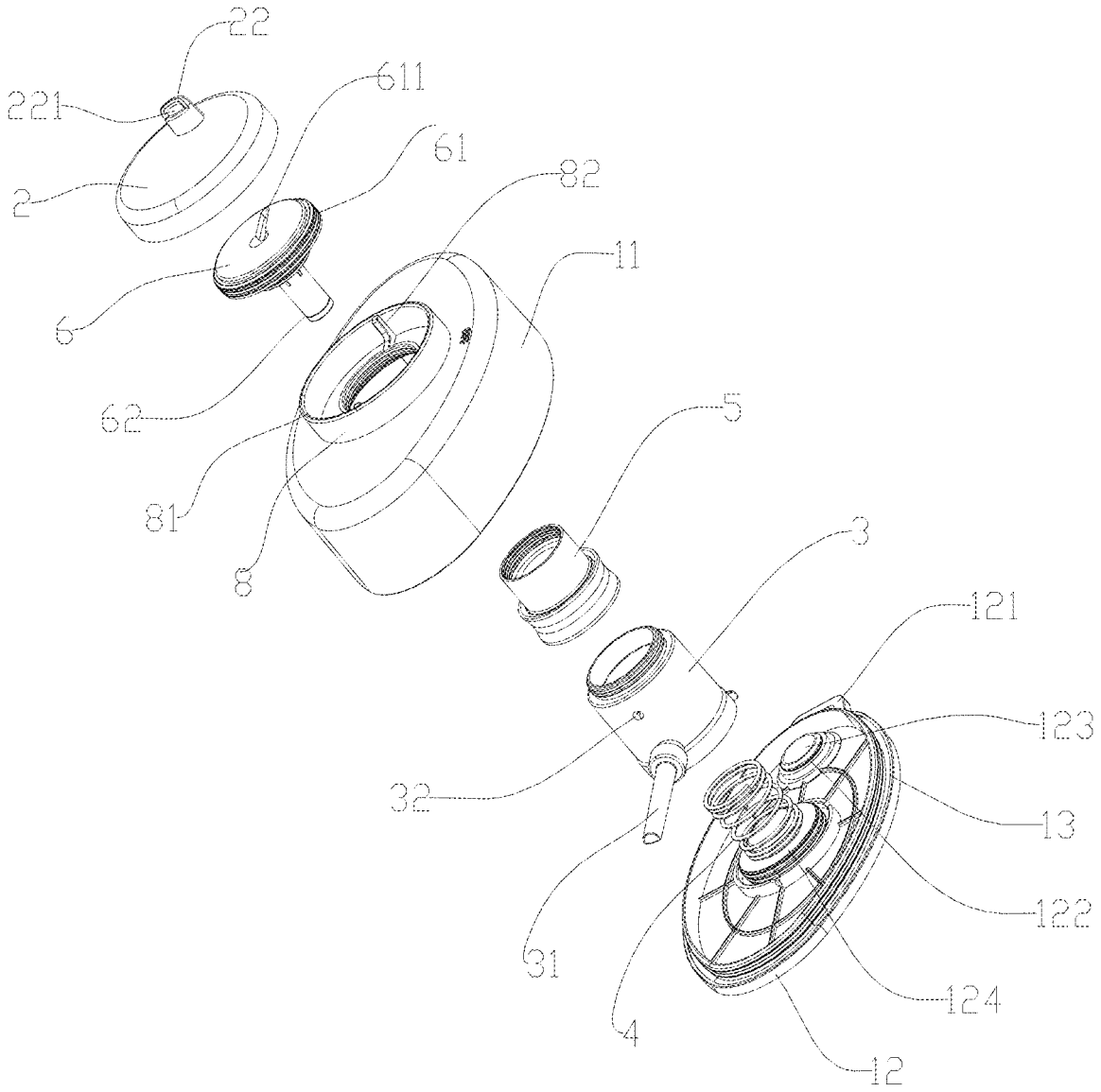
FIG. 2 is an exploded view of an overall structure of the portable pump of the present disclosure.

As shown in FIGS. 1 to 2, the liquid storage container 1 comprises a front cover 11 and a rear cover 12 that are horizontally assembled, and a sealing ring 13 is provided at a joint between the front cover 11 and the rear cover 12. The liquid storage container 1 is formed by horizontally assembling the separately formed front cover 11 and the rear cover 12, which is advantageous for processing and production separately, or manufacturing a combination of different colors, which increases the appearance. It is more benefit to mount the liquid suction device and components of the pump head 1 to improve production efficiency.

The pump head 2 is provided in a middle portion of a side of the front cover 11. Especially for the design of the pump head 1 that is pressed on the side, the applied force is dispersed and the liquid storage container is evenly stressed, which ensures the stability of the portable pump and extends the service life.

A top of the back cover 12 is further provided with a hanging ring 121, such that the user can hang the portable pump on a belt or a pocket of clothes and carry it around. An upper portion of the rear cover 12 is provided with a liquid filling hole 122, and a hole plug 123 is provided on the liquid filling hole 122. The user can fill the stored liquid through the liquid filling hole 122, and seal the liquid filling hole 122 through the hole plug 123 for use.

Figure 3:
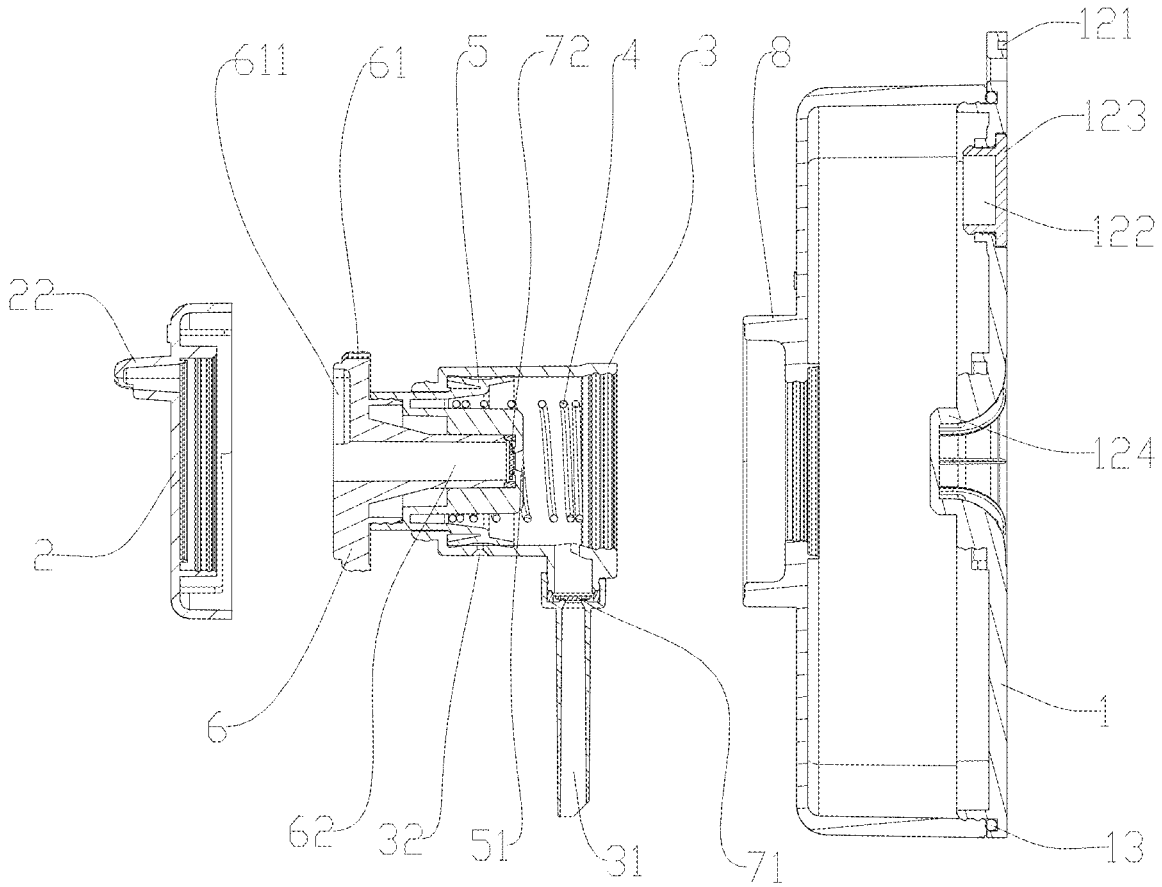
FIG. 3 is a cross-sectional view of an assembled state of the pump head, liquid suction device, and liquid storage container of the portable pump of the present disclosure.
Figure 4:
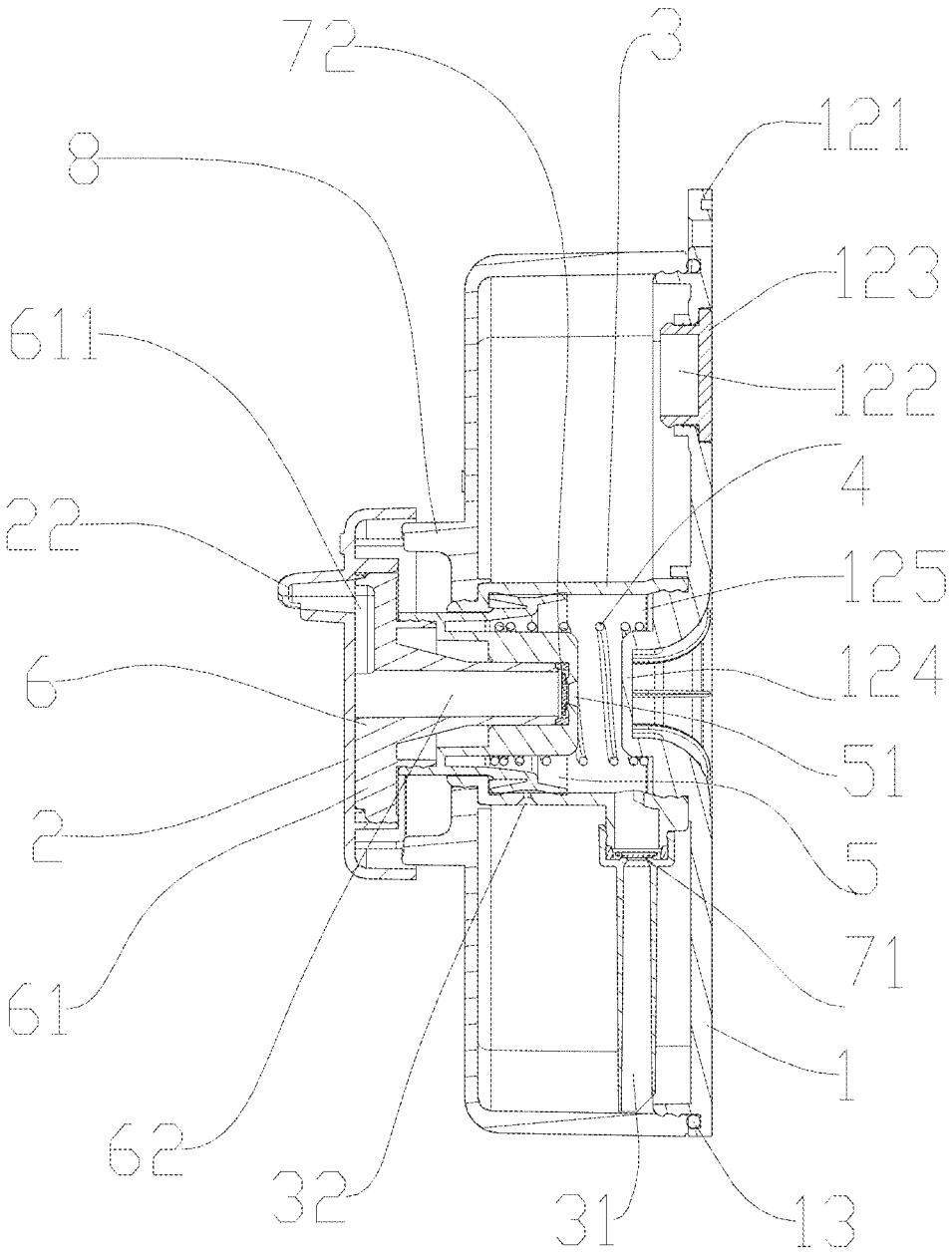
FIG. 4 is a cross-sectional view of the portable pump of the present disclosure.

As shown in FIGS. 2 to 4, the liquid suction device comprises a liquid suction chamber 3, a spring 4, a piston 5, and a liquid outlet pipe 6 connected to the pump head 2. The liquid suction chamber 3 is provided with a liquid inlet pipe 31 and a fixed end 124 of the spring. The liquid outlet pipe 6 and the liquid inlet pipe 31 are provided with a first check valve 71 and a second check valve 72, respectively.

Preferably, the first check valve 71 of the liquid inlet pipe 31 only opens to the inside of liquid suction chamber 3, and the second check valve 72 of the outlet pipe 6 only opens to a direction towards the pump head 2.

The piston 5 is sleeved with the liquid outlet pipe 6. A bottom of the piston 5 is provided with a through hole 51 matching an opening of the liquid outlet pipe 6. One end of the spring 4 is fixed to the fixed end 124, and the other end thereof is connected to the piston 5. Under the pressing of the pump head 2, the piston 5 is driven to move horizontally in the liquid suction chamber 3.

When the user operates the pump head 2 and presses it horizontally into the liquid storage container 1, the piston 5 is driven to move horizontally in the liquid suction chamber 3, and the stored liquid in the liquid suction chamber 3 is squeezed into the liquid outlet pipe 6 and pumped out of the pump head 2. When the piston 5 is reset, the stored liquid in the liquid storage container 1 is pumped from the liquid inlet pipe 31 into the liquid suction chamber, reserved for the next liquid output, such that the portable pump can realize the quantitative output of the liquid storage.

Figure 5:
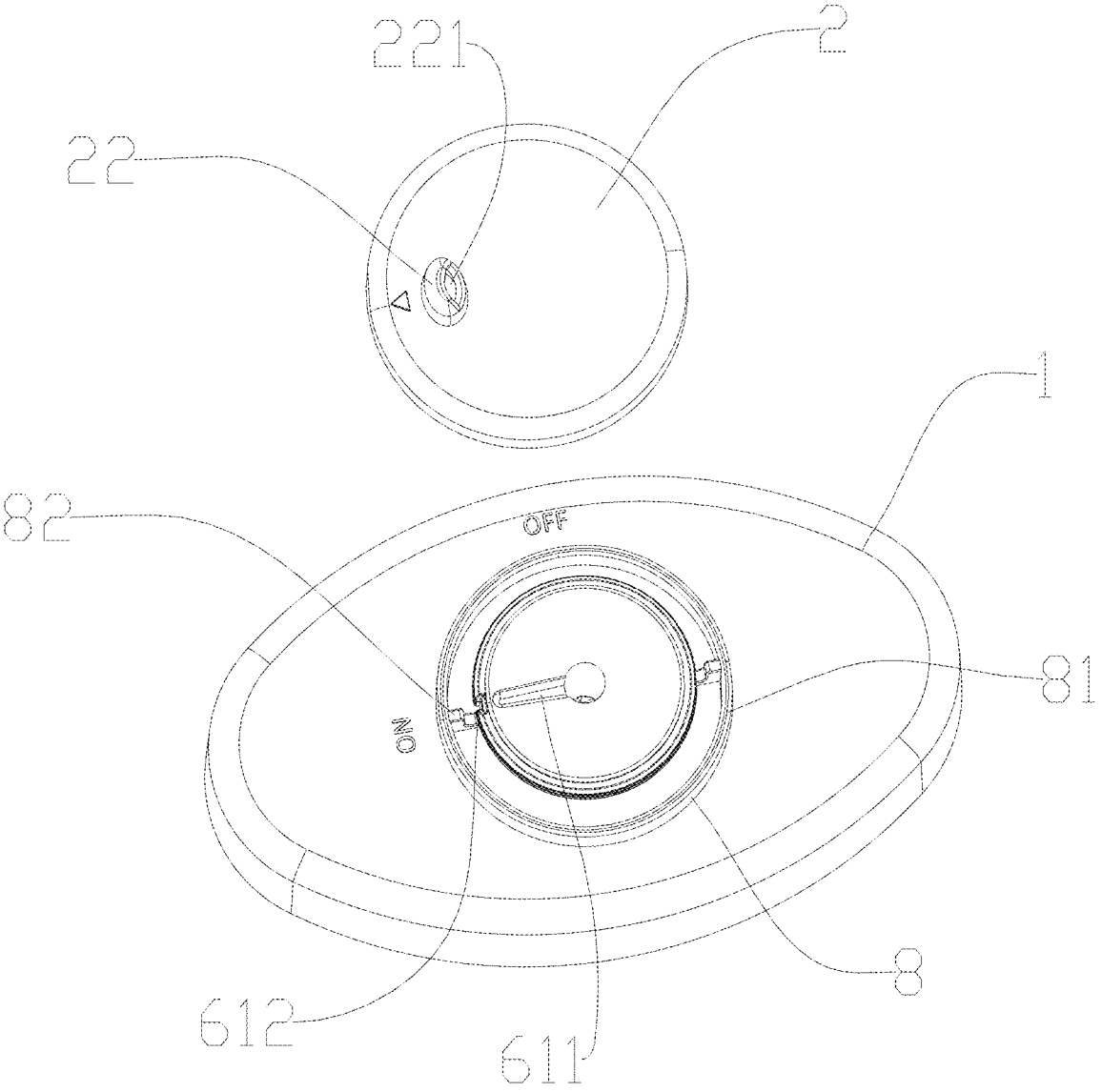
FIG. 5 is an exploded view of the pump head and liquid storage container of the portable pump of the present disclosure.
Figure 6:
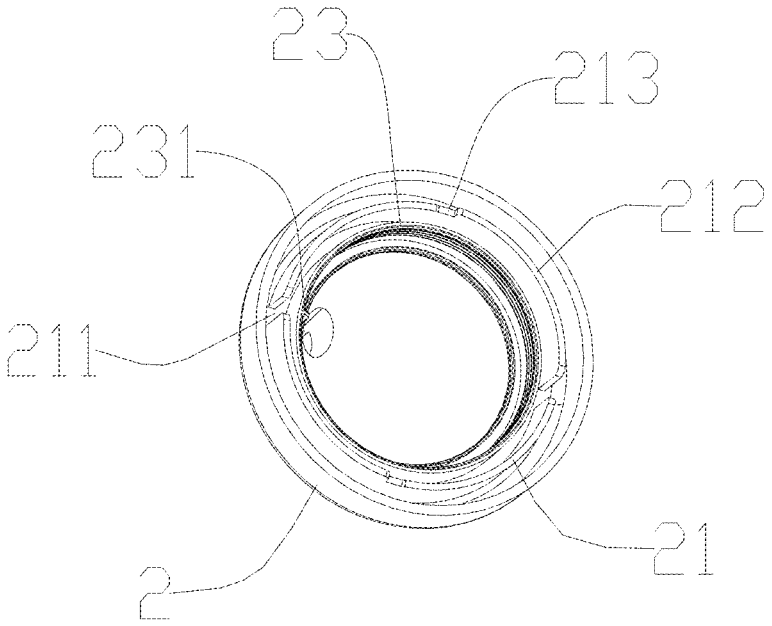
FIG. 6 is a bottom structural view of the pump head of the portable pump of the present disclosure.

In order to further enhance the sealing performance of the liquid output structure, as shown in FIGS. 5 to 6, the portable pump further comprises a locking structure of the pump head 2, the pump head 2 is shaped as a cap. The locking structure is a locking seat 8 matching with the pump head 2 cover on the side of the liquid storage container 1. The locking seat 8 has a ring opening 81 provided in a form of an annular opening, and a positioning block 82 is provided in the ring opening 81. A convex ring 21 sleeved with the ring opening 81 is provided at a bottom of the pump head 2. The convex ring 21 is provided with a notch 211 and a limiting convex edge 212.

The user can operate the pump head 2 to rotate on the locking seat 8 with one hand to realize the switch setting. In the rotation operation of the pump head 2, the convex ring 21 rotates axially in the ring opening 81. When the pump is rotated by a certain angle, it can be preferably set to a matching structure of 45 degrees. When the notch 211 is aligned with the positioning block 82, it is in an unlocked state, the positioning block 82 is embeddedly matched the notch 211 to unlock the pressing movement of the pump head 2; otherwise, the positioning block 82 and the convex ring 21 are abutted with each other, thereby limiting the pressing operation of the pump head 2.

Preferably, a depth of the notch 211 is adapted to a height of the positioning block 82, and matches with a horizontal displacement stroke of the piston 5 in the liquid suction chamber 3, so as to facilitate the combination of the entire locking structure and the liquid suction device. When the pressing movement of the pump head 2 is unlocked, a stroke that the user presses the pump head 2, the depth of the notch 211 that embedded with the positioning block 82 of the locking structure, and the horizontal displacement stroke of the piston 5 in the liquid suction chamber 3 in the liquid suction device match with one another, so as to effectively and accurately control the amount of liquid outlet and to further enhance the sealing performance.

On the basis of the above, as shown in FIG. 6, the convex ring 21 is further provided with a positioning groove 213, one end of the limiting convex edge 213 is connected to the notch 211, and the other end thereof is connected to the positioning groove 213. The positioning block 82 rotates along with the pump head 2, slides against and along the surface of the convex ring 21 until the positioning block reaches the limiting convex edge 213, and is embedded into the positioning groove 213, such that the pump head is in a locked state. In actual operation, after the user operates the pump head 2 to rotate to a certain angle, it can be matched with the above unlocked state, and is preferably set to a matching structure of reversed 45°. The positioning block 82 of the locking structure slides into the positioning groove 213 to form the locked state, such that the pump head 2 is locked and fixed to avoid the situation of liquid leakage and liquid seepage.

The cooperation structure of the locking structure and the liquid suction device can be optimized. As shown in FIG. 5, a liquid outlet nozzle 22 is provided on a side of the pump head 2, and the opening 221 of the liquid outlet nozzle 22 faces a middle portion of the pump head 2. When the pump head 2 is in the unlocked state, the liquid outlet nozzle 22 is located on an upper side of the pump head 2. Especially for a portable pump that presses the liquid out on the side, when the user performs the rotating operation to the pump head 2 and rotates the liquid outlet nozzle 22 on the pump head 2 to the upper side, the pressing movement of the pump head 2 is unlocked, and the user can press the pump head 2 to let the stored liquid flow out of the opening 221 of the liquid outlet nozzle 22 downward to use the stored liquid.

Figure 7:
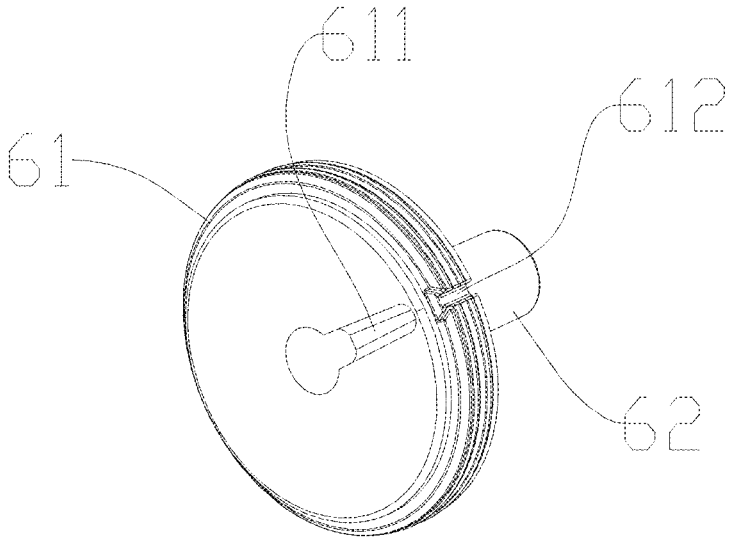
FIG. 7 is a structural view of the liquid outlet pipe of the portable pump of the present disclosure.

On the basis of the above, the structure of the liquid outlet pipe 6 can be improved. As shown in FIGS. 4, 6 to 7, the liquid outlet pipe 6 comprises a connecting end 61 embedded at the bottom of the pump head 2, and a liquid guiding pipe 62 sleeved with the piston 5. The connecting end 61 is shaped as a round disk and is provided with a liquid outlet channel 611 in communication with the liquid guiding pipe 62. The liquid outlet channel 611 extends outward, an edge of the connecting end 61 aligned with an end opening of the liquid outlet channel 611 is provided with a positioning slot 612. The bottom of the pump head 2 is further provided with an inner ring 23, the inner ring 23 is provided with a convex block 231 aligned with the notch 211. When the pump head 2 is in the unlocked state, the positioning slot 612 of the connecting end 61 and the convex block 231 on the inner ring 23 of the pump head 2 are embedded and positioned with each other, such that the liquid outlet nozzle 22 on the pump head 2 and the end opening of the liquid outlet channel 611 are aligned with each other.

When the user operates the pump head 2 to rotate to the unlocked state, the positioning slot 612 of the connecting end 61 and the convex block 231 on the inner ring 23 of the pump head 2 are embedded and positioned with each other, such that the liquid outlet nozzle 22 on the pump head 2 and the end opening of the liquid outlet channel 611 are aligned with each other. In this state, the operation of pressing the liquid out of the pump head 2 is performed, and the stored liquid is pumped into the liquid guiding pipe 62 from the liquid suction chamber 3 through the through hole 51 of the piston 5, then enters the liquid outlet channel 611 on the connecting end 61, and finally flows out from the liquid outlet nozzle 22. Since the liquid outlet channel 611 is in a vertical state at the moment, after the liquid is output, the residual liquid will flow back to the liquid guiding pipe 62 with the liquid outlet channel 611, which effectively forms a structure to control the flow back of residual liquid, so as to avoid leakage of residual liquid remaining on the liquid outlet nozzle 22, which affects hygiene of clothing for users.

In order to allow the air pressure in the liquid storage container 1 to circulate and allow the liquid suction device to pump out the stored liquid normally, it is necessary to provide a structure in the suction chamber 3 that enables exchange with external air, thus the structure of the liquid suction device is further optimized. As shown in FIGS. 2 to 4, a sidewall of the liquid suction chamber 3 is provided with a vent hole 32. The vent hole 32 is located on a lower side of the liquid suction chamber 3, and is isolated by the piston 5, such that the vent hole 32 is isolated from a liquid storage space of the liquid suction chamber 3. When the user presses the pump head 2, the piston 5 moves horizontally into the liquid suction chamber 3 to squeeze out the stored liquid in the storage space of the liquid suction chamber 3. At the same time, the vent hole 32 at the other end of the piston 5 performs an air exchange between the external air and the liquid storage container 1, such that the interior of the liquid storage container can communicate with the external air pressure through the liquid suction device, and therefore the portable pump can maintain a normal liquid pumping operation.

For this type of portable pump by which liquid is output by pressing the pump head 2 on the side, since the entire liquid suction device and the pump head 2 are horizontally arranged in the liquid storage container 1, the stored liquid is not evenly distributed on a peripheral wall of the liquid suction device, which is different from the conventional pump that is arranged vertically. In order to enhance the pumping effect of the piston 5, the fixed end 124 of the spring 5 is optimized. As shown in FIG. 4, the fixed end 124 of the spring 5 is provided at a middle portion of an inner side of the rear cover 12. The fixed end 124 is a protrusion horizontally sleeved by the spring 5. A concave ring 125 is formed between an outer side of the protrusion and an inner wall of the liquid suction chamber 3. When the piston 5 is pressed and gradually assembles the protrusion, the stored liquid in the liquid suction chamber 3 is concentrated back through the concave ring 125, squeezed out into the through hole of the piston 5 and pumped into the liquid outlet pipe 6. The concave ring 125, the piston 5, and the inner wall of the liquid suction chamber 3 are effectively used to enclose together to form a flow back channel for the stored liquid, such that the stored liquid can be efficiently concentrated and output, the residual liquid in the storage space of the liquid suction chamber can be prevented from mixing with the stored liquid that is newly pumped into the storage space at the next time, which affects the quality of the outputting stored liquid.

According to the disclosure and teaching of the above description, person skilled in the art to which the present disclosure belongs can also make changes and modifications to the embodiments mentioned above. Therefore, the present disclosure is not limited to the specific embodiments disclosed and described above, and some modifications and changes to the present disclosure should also fall within the scope of protection of claims of the present disclosure. In addition, although some specific terms are used in this description, these terms are only for convenience of description and do not constitute any limitation to the present disclosure.

What is claimed is:

1. A portable pump by which liquid can be horizontally pressed out, the portable pump comprising (i) liquid storage container, (ii) a pump head provided on a side of the liquid storage container, and (iii) a locking structure of the pump head, the portable pump characterized in that:

a liquid suction device connected to the pump head is provided in the liquid storage containers;

the liquid suction device comprises a liquid suction chamber, a spring, a piston, and a liquid outlet pipe connected to the pump head;

the liquid suction chamber is provided with a liquid inlet pipe and a fixed end of the spring;

the liquid outlet pipe and the liquid inlet pipe are provided with a check valve, respectively;

the piston is sleeved with the liquid outlet pipe and is provided with a through hole matching with an opening of the liquid outlet pipe;

one end of the spring is fixed at the fixed end, and the other end of the spring is connected to the piston;

the pump head is shaped as a cap;

the locking structure is a locking seat provided on the side of the liquid storage container and matching with a pump head cover;

the locking seat has a ring opening provided in a form of an annular opening;

a positioning block is provided in the ring opening;

a convex ring sleeved with the ring opening is provided at a bottom of the pump head;

the convex ring is provided with a notch and a limiting convex edge; and the portable pump is configured so that:

under the pressing of the pump head, the piston is driven to move horizontally in the liquid suction chamber;

when the piston is reset, stored liquid in the liquid storage container is pumped into the liquid suction chamber from the liquid inlet pipe; and when the piston is pressed, the stored liquid in the liquid suction chamber is squeezed into the liquid outlet pipe and pumped out of the pump head; and the portable pump is configured so that:

when the pump head is operated to rotate, the convex ring rotates axially in the ring opening;

when the notch is aligned and embeddedly matched with the positioning block, the pressing movement of the pump head is unlocked; and otherwise the positioning block and the convex ring are abutted with each other, thereby limiting the pressing operation of the pump head.

2. The portable pump according to claim 1, wherein a depth of the notch is adapted to a height of the positioning block and matches with a horizontal displacement stroke of the piston in the liquid suction chamber.

3. The portable pump according to claim 2, wherein the convex ring is further provided with a positioning groove, one end of the limiting convex edge is connected to the notch, and the other end thereof is connected to the positioning groove; the positioning block rotates along with the pump head, slides against and along the surface of the convex ring until the positioning block reaches the limiting convex edge and is embedded in the positioning groove, such that the pump head is in a locked state.

4. The portable pump according to claim 3, wherein a liquid outlet nozzle is provided on a side of the pump head, and an opening of the liquid outlet nozzle faces a middle portion of the pump head; when the pump head is in an unlocked state, the liquid outlet nozzle is located on an upper side of the pump head.

5. The portable pump according to claim 4, wherein the liquid outlet pipe comprises a connecting end embedded at the bottom of the pump head, and a liquid guiding pipe sleeved with the piston, the connecting end is shaped as a round disk and is provided with a liquid outlet channel in communication with the liquid guiding pipe, the liquid outlet channel extends outward, an edge of the connecting end aligned with an end opening of the liquid outlet channel is provided with a positioning slot; the bottom of the pump head is further provided with an inner ring, the inner ring is provided with a convex block aligned with the notch; when the pump head is in the unlocked state, the positioning slot of the connecting end and the convex block on the inner ring of the pump head are embedded and positioned with each other, such that the liquid outlet nozzle on the pump head and the end opening of the liquid outlet channel are aligned with each other.

6. The portable pump according to claim 1, wherein a sidewall of the liquid suction chamber is further provided with a vent hole, the vent hole is located on a lower side of the liquid suction chamber and is isolated by the piston, such that the vent hole is isolated from a liquid storage space of the liquid suction chamber.

7. The portable pump according to claim 1, wherein the liquid storage container comprises a front cover and a rear cover that are horizontally assembled, a sealing ring is provided at a joint between the front cover and the rear cover, the pump head is provided at a middle portion of a side of the front cover.

8. The portable pump according to claim 7, wherein the fixed end of the spring is provided at a middle portion of an inner side of the rear cover, the fixed end is a protrusion horizontally sleeved by the spring, a concave ring is formed between an outer side of the protrusion and an inner wall of the liquid suction chamber, when the piston is pressed to gradually assemble the protrusion, the stored liquid in the liquid suction chamber is concentrated back through the concave ring, squeezed out through the through hole of the piston and pumped into the liquid outlet pipe.

9. The portable pump according to claim 8, wherein a top of the rear cover is further provided with a hanging ring, an upper portion of the rear cover is provided with a liquid filling hole, and a hole plug is provided on the liquid filling hole.

* * * * *